US006526954B1

(12) United States Patent
Baranzahi et al.

(10) Patent No.: US 6,526,954 B1
(45) Date of Patent: Mar. 4, 2003

(54) SYSTEM, SENSOR COMBINATION AND METHOD FOR REGULATING, DETECTING AS WELL AS DECIDING CURRENT FUEL-AIR RATIOS IN COMBUSTION ENGINES

(75) Inventors: Amir Baranzahi, Kumla (SE); Per Mårtensson, Linköping (SE); Anders Göras, Åmål (SE); Per Salomonsson, Göteborg (SE)

(73) Assignee: AB Volvo and Mecel AB (SE)

( * ) Notice: Subject to any disclaimer, the term of this patent is extended or adjusted under 35 U.S.C. 154(b) by 0 days.

(21) Appl. No.: 09/529,323

(22) PCT Filed: Oct. 9, 1998

(86) PCT No.: PCT/SE98/01828

§ 371 (c)(1),
(2), (4) Date: Oct. 17, 2000

(87) PCT Pub. No.: WO99/19611

PCT Pub. Date: Apr. 22, 1999

(30) Foreign Application Priority Data

Oct. 12, 1997 (SE) ..... 9703754

(51) Int. Cl.[7] ..... F02D 41/14

(52) U.S. Cl. ..... 123/673; 73/23.32

(58) Field of Search ..... 123/673, 691, 123/703; 73/23.31, 23.32

(56) References Cited

U.S. PATENT DOCUMENTS

| | | | | |
|---|---|---|---|---|
| 4,337,746 A | * | 7/1982 | Masaki et al. | 123/691 |
| 4,962,741 A | * | 10/1990 | Cook et al. | 123/673 |
| 4,993,386 A | * | 2/1991 | Ozasa et al. | 123/691 |
| 5,265,416 A | | 11/1993 | Hamburg et al. | 60/274 |
| 5,385,016 A | | 1/1995 | Zimlich et al. | 60/274 |

FOREIGN PATENT DOCUMENTS

| | | |
|---|---|---|
| DE | 196 22 176 C 1 | 6/1996 |
| WO | 96/09534 | 3/1996 |

* cited by examiner

*Primary Examiner*—Andrew M. Dolinar
(74) *Attorney, Agent, or Firm*—Lerner, David, Littenberg, Krumholz & Mentlik, LLP

(57) ABSTRACT

A system for regulating the fuel-air mixture in a multi-cylinder internal combustion engine. The system utilizes binary sensors to detect relative deviations from stoichiometric combustion, including individual combustion events, and allows for regulation to achieve optimal and similar combustion to take place in all the cylinders.

7 Claims, 4 Drawing Sheets

SYSTEM, SENSOR COMBINATION AND METHOD FOR REGULATING, DETECTING AS WELL AS DECIDING CURRENT FUEL-AIR RATIOS IN COMBUSTION ENGINES

The present invention concerns a system for regulating the fuel-air mixture in internal combustion engines, a sensor combination for a similar system, and an arrangement for determining the fuel-air mixture in an internal combustion engine.

TECHNOLOGICAL STANDPOINT

With the aim of regulating the combustion in an internal combustion engine, so that an optimal stoichiometric combustion takes place for the catalytic converter, sensors in the exhaust system are used, which detect the proportion of residual oxygen in the exhaust gases. Stoichiometric combustion is desirable in order that the catalytic converter shall operate most efficiently and minimise the emission of $NO_x$, HC and CO. The sensors used for this purpose are principally sensitive to the transport of oxygen ions, and are generally called lambda sensors. A characteristic of these sensors is that they are relatively slow to act, and in reality provide an averaged signal that spans several sequential combustion events. A normal step response from such a sensor is that there is a delay in the order of 20 to 30 combustion events before the sensor achieves a new stable output signal level after a change in the actual air-fuel mixture. One disadvantage with this type of sensor is that if it is installed in the exhaust system downstream (with respect to the direction of gas flow) of the exhaust manifold in a multi-cylinder engine, in a position where the exhaust gases from all the cylinders have combined, this can often result in regulation so that individual cylinders run rich while the others run lean, although the combined gas flow indicates stoichiometric combustion has been achieved. The alternative is to arrange a separate sensor in the exhaust gas flow from each individual cylinder, but this would be very expensive. A conventional binary lambda sonde costs at the consumer level about SEK 1200–1400 (□135–158), and linear lambda sondes cost between 10 and 20 times as much as binary sensors.

By using sensors of the type shown in SE.A.9403218-2 (=PCT/SE95/01084) any change in the fuel-air mixture can be detected much more quickly. This sensor is also of a binary type, where the sensor output signal quickly changes from one level to another depending on whether the proportion of hydrogen ($H_2$) in the exhaust gases exceeds or is less than a predetermined value.

OBJECT OF THE INVENTION

The object of the present invention is with only one binary sensor to be able to quickly detect relative deviations from stoichiometric combustion, even for individual combustion events in a multi-cylinder internal combustion engine. From this basis it will easily be possible to regulate all the cylinders equally, so that optimal and similar combustion can take place in all the cylinders. Uneven combustion in a set of cylinders can result in individual cylinders running rich and thereby building up soot deposits. This soot can give rise to so-called hot spots, inducing knocking. In those cylinders which are running lean, the lean combustion itself can increase the risk of knocking. For every type of anti-knock measure the engine deviates from optimal regulation and its fuel consumption increases.

Another reason is to limit emissions, which will be the result if all cylinders can be regulated for stoichiometric combustion. Even small deviations from stoichiometric combustion, for example with excess air content variations in the region of $\Delta\lambda \approx 0.001$–$0.002$, will reduce catalytic converter efficiency from 98% to 80–85%.

A further reason is closer regulation of the fuel supply to multi-cylinder internal combustion engines using fuel injectors, permitting lower tolerance claims in the manufacture of the fuel injector components. The need is reduced for a continuous tightening of manufacturing tolerances for fuel injectors, or the alternative of matching individual fuel injectors with similar dynamic responses, with the aim of meeting ever more stringent emission claims.

Yet another purpose is that with a special sensor combination it will be possible to detect relative deviations in both the rich and lean directions away from stoichiometric combustion.

BRIEF DESCRIPTION OF THE INVENTION

By means of the present invention the fuel supply to each cylinder can be regulated in an optimal manner such that stoichiometric combustion takes place in each cylinder.

By means of the sensor combination of the present invention, relative deviations relative to stoichiometric combustion can be detected, in both rich and lean burn directions, using only a sensor element providing a binary type of output signal.

By means of the general process of the invention detection of the relative deviation from stoichiometric combustion in every cylinder is assured, based upon a sensor of binary type.

Other particularly remarkable characteristics and advantages deriving from the present invention are apparent in the other patent claim characteristic parts and in the subsequent description of an application example. The description of the application example utilises references to the illustrations defined in the following list of drawings.

LIST OF DRAWINGS

Figure 4:
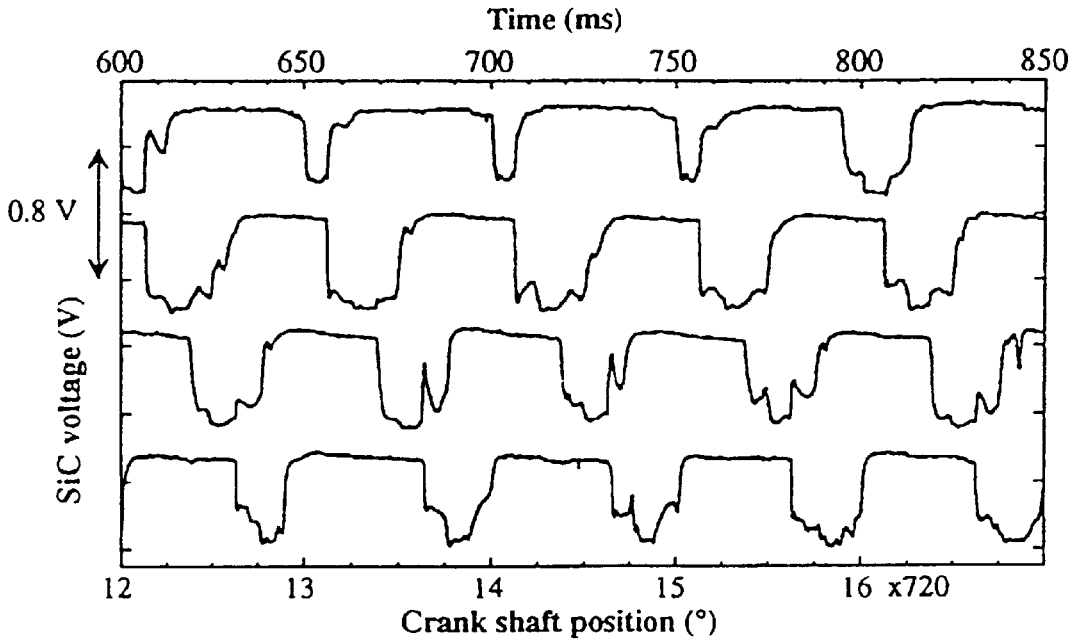
FIG. 4 shows the output signal from a sensor of the type shown in FIG. 3 when in use as an exhaust gas sensor (sensor 10) in a system equivalent to that shown in FIG. 1.
Figure 5A:
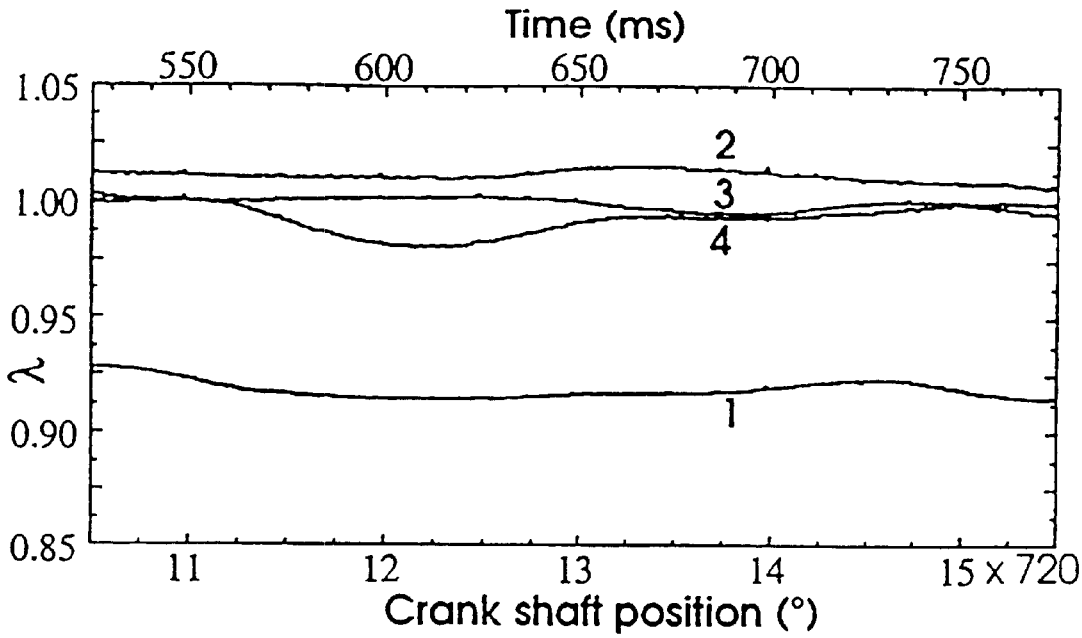
Figure 5B:
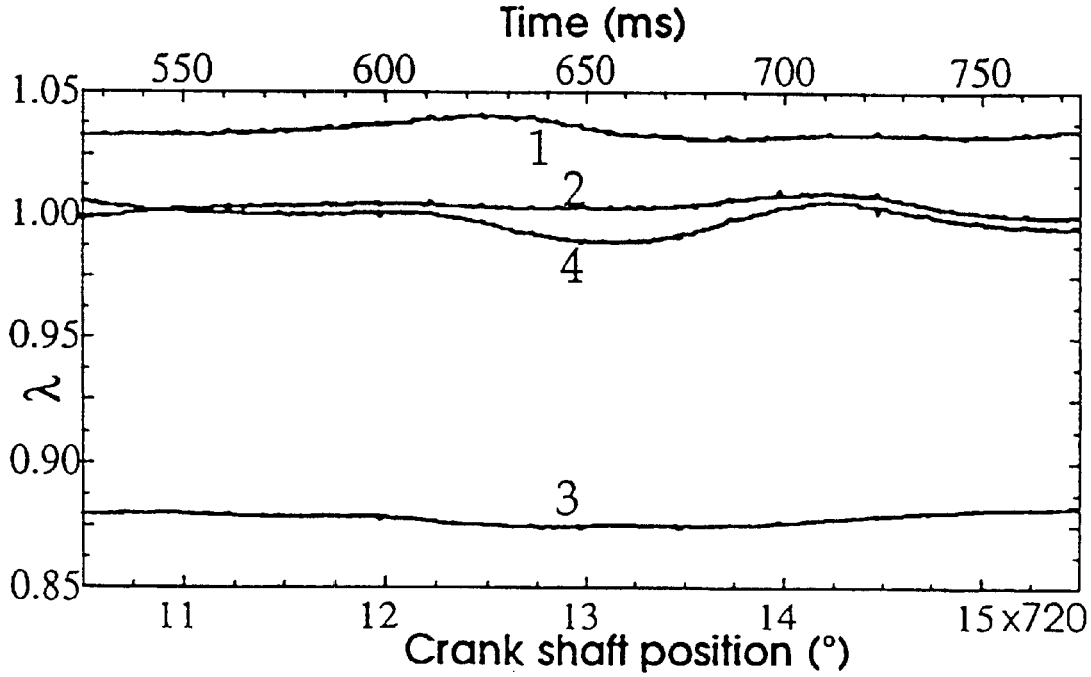

FIGS. 5*a* and 5*b* respectively show the excess air factors from the four cylinders from the first curve from the top and second curve from the top respectively in FIG. 4.

DESCRIPTION OF AN APPLICATION EXAMPLE

Figure 1:
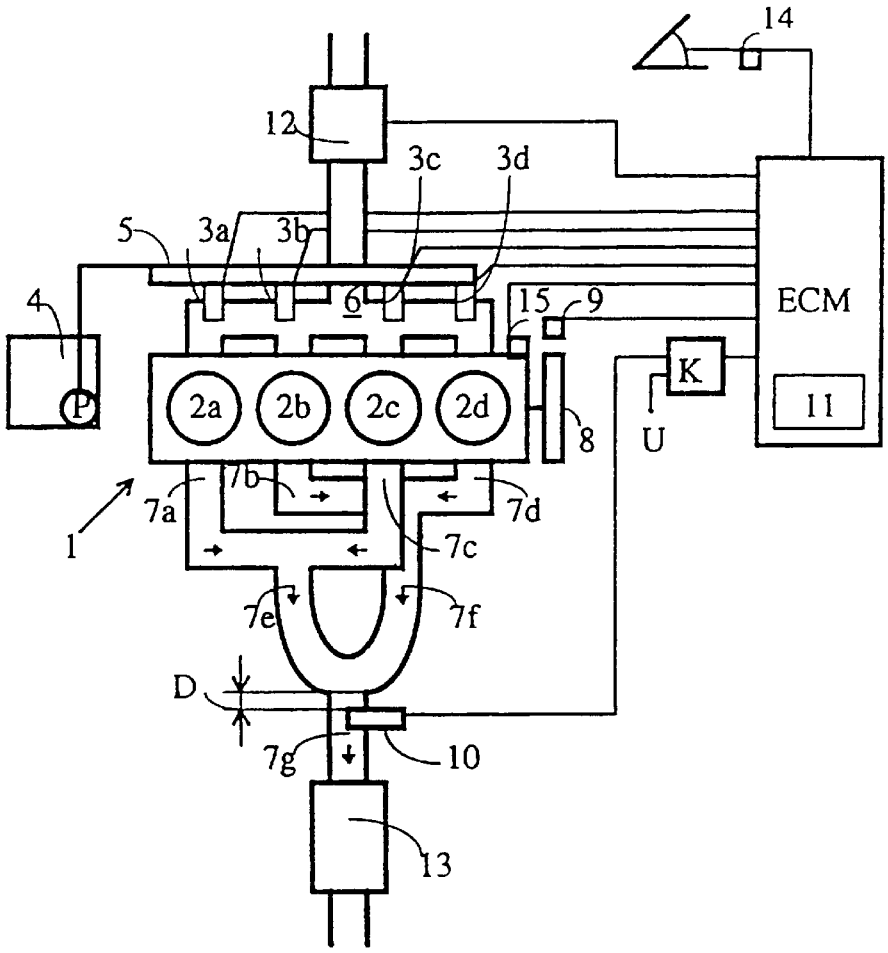
FIG. 1 shows diagrammatically an internal combustion engine with a system for regulating the fuel-air mixture.

FIG. 1 shows diagrammatically an internal combustion engine 1 equipped with a regulatory system for its fuel supply. In the conventional way fuel is delivered to cylinders 2*a*, 2*b*, 2*c* and 2*d* with the aid of fuel injectors 3*a*, 3*b*, 3*c* and 3*d* respectively, arranged in the inlet manifold 6, and directed toward the respective inlet valves for the cylinders. Injectors 3*a*–3*d* are located in a fuel distribution rail pipe 5 which is supplied with fuel from a fuel tank 4 by means of a pump 4. The contents of the fuel rail pipe 5 are under continuous pressure at a principally constant pressure level and the amount of fuel that is sprayed into the combustion chamber through the inlet valve is determined by the time period of an electrical control pulse transmitted from and controlled by an engine control unit, ECM. The Figure shows a system in which the pump can be controlled by pressure, but alternatively a system with excess fuel returning to the tank 4 via a pressure-reducing valve can be used. The Figure shows a fuel system of so-called low pressure type, whereby an indirect supply of fuel to the cylinders takes place through the fuel injectors pointing towards the inlet valves. Engines with fuel injected directly into the cylinders may also be used.

The engine control unit ECM adapts the actual length of time of the controlling pulse to the respective fuel injectors 3*a*–3*d* in response to a number of parameters. The actual engine rotation speed and crankshaft position are determined by a pulse sender 9, which in a conventional manner detects the presence of the gear teeth on the periphery of the flywheel 8. Sensors 14 and 15 detect the accelerator pedal position and engine coolant temperature respectively. The actual mass of the air entering the cylinders is detected by an air mass sensor 12, and this is used to determine the load on the engine. Depending on the values at any instant of these specified detected engine parameters the engine control unit then ensures that a suitable quantity of fuel is delivered, as determined by an empirical engine load, engine speed and coolant temperature matrix, along with the influence of the driver on the accelerator pedal position 14.

With the aim of reducing emissions from the combustion process, a so-called three-way catalytic converter is installed in the conventional manner in the exhaust piping 7*g*. The catalytic converter can reduce the levels of $NO_x$, and CO, while HC is oxidised with very high efficiency of approximately 98% in the presence of a stoichiometric combustion relationship of air to fuel. The proportion of residual oxygen in the exhaust gases is a function of the air-fuel mixture ratio, so that the level of oxygen in the exhaust gases can be used to determine the excess air factor ($\lambda$). Normally an oxygen sensor of binary type, called a lambda sonde, is used, which provides an output signal with a distinct switching point when the excess air factor $\lambda$ falls below 1.0. This type of binary sensor usually presents a principally low voltage output while the excess air factor is greater than 1.0, and delivers a higher output voltage if the excess air factor falls below 1.0. This is used to correct the value of fuel to be supplied primarily determined by the matrix, whereupon the engine control unit with as small changes in fuel supply as possible tries to keep the output signal from the lambda sonde continuously switching between low and high signal outputs. Usually, regulation using this type of switching in normal operation means the output signal changes at a rate in the order of once per second. A disadvantage of this type of sensor is that it is relatively slow, and there may be a delay of ten or more combustion events before the signal changes from indicating too much to too little air, which makes it unsuitable for detecting the combustion products from an individual cylinder, if it is installed as shown in FIG. 1 in the exhaust piping 7*g*.

Figure 2:
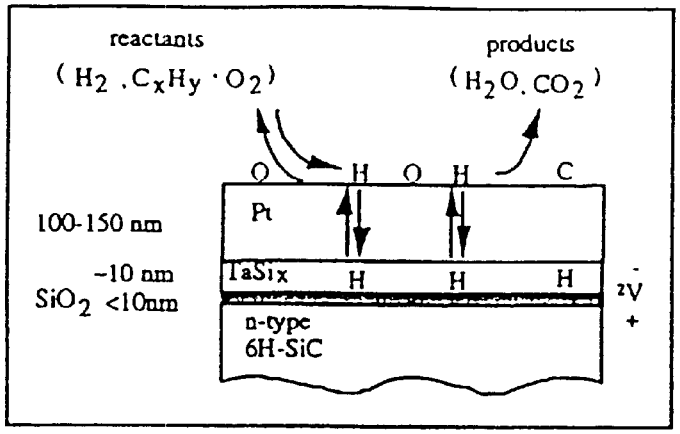
FIG. 2 shows the reaction principle in a sensor that is used in accordance with the present invention.

FIG. 2 shows schematically the structure of a sensor and its gas detection principle together with the chemical reactions within such a sensor that is used in accordance with the present invention. The sensor is sensitive to hydrogen ($H_2$) and the principle of this type of semiconductor sensitivity has been described in "A Hydrogen Sensitive MOS-Transistor, J. Appl. Phys. 46 (1975) 3876–3881. K. I. Lundström, M. S. Shivaraman & C. Svensson". The principle is that hydrogen $H_2$ diffuses down through the metallic film and forms an electrically polarised layer on the insulated stratum ($SiO_2$). The polarised layer causes a voltage drop $\Delta V$. For the real high temperature application, a silicon carbide (SiC) substrate is used. During the manufacture of the sensor, the SiC substrate is cleaned and oxidised so that a film of $SiO_2$ is formed. Thereupon a resistive contact consisting of a 200 nm layer of $TaSi_x$ and a 400 nm layer of Pt is deposited.

Figure 3:
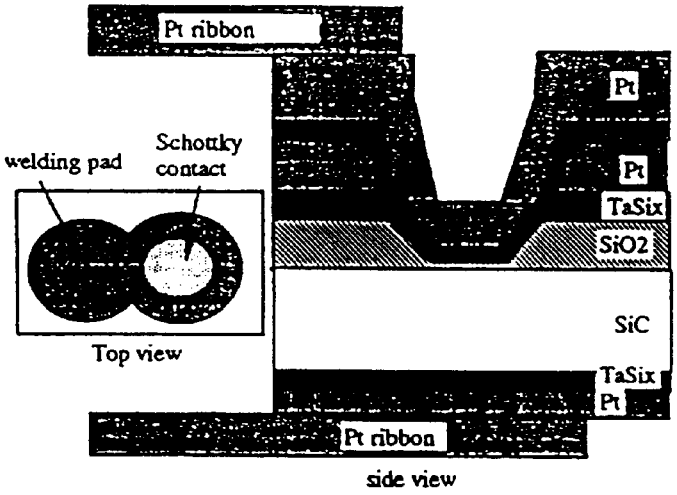
FIG. 3 shows the design of a sensor which, depending on the actual level of hydrogen present, provides a distinct changeover point in its output signal.

In order to obtain a functional sensor in accordance with FIG. 3 a pit is etched in from above, with a diameter of approximately 0.7 mm. FIG. 3 shows both a side elevation and a plan view of the physical sensor. The contact area consists of a 200 nm layer of $TaSi_x$ and a 400 nm layer of Pt deposited by means of DC-magnetron sputtering at a temperature of 350° C. Thereafter, using the same technique, a control electrode is deposited, consisting of a 10 nm layer of TsSiX and 100 nm Pt, which partly overlaps the contact surfaces. Finally platinum (Pt) ribbons are welded to the contact surfaces. The sensor can then be mounted using ceramic glue on a conventional ceramic support, preferably a ceramic support with temperature regulation, equivalent to the support used for a conventional lambda sonde.

FIG. 4 shows how the signal from the sensor appears if it is installed in a system equivalent to that shown in FIG. 1. Sensor 10 is installed in the exhaust piping 7*g* immediately downstream of the junction of exhaust stubs 7*e* and 7*f*. The exhaust stubs 7*e* and 7*f* collect the exhaust gases from cylinders 2*a* and 2*c*, and 2*b* and 2*d* respectively. This type of exhaust gas system is used in four-cylinder internal combustion engines where the order of ignition is 2*a*-2*c*-2*d*-2*b*, in which case the pressure pulse that is created in the exhaust gas valve opening should not affect the exhaust gas flow from the cylinder that had opened its exhaust valve immediately beforehand. FIG. 1 shows a rather asymmetrical exhaust gas system, but a symmetrical exhaust gas system is to be preferred, in which every cylinder has the same equivalent length of exhaust gas piping and union downstream to sensor 10.

The four curves in FIG. 4 show the response of the sensor to a repeated (5 times) and identically rich combustion event in only one of the four cylinders. The curves show, seen from the top, rich combustion in cylinders 2*a*, 2*c*, 2*d* and 2*b* respectively, at an engine speed of 2400 rpm. The response of the sensor to the rich combustion is shown as a reduced voltage (SiC voltage). The upper curve in FIG. 1 shows the signal from the sensor if the fuel supply to cylinder 2*a* is being regulated to achieve a $\lambda$ value of about 0.92, while the $\lambda$ values for cylinders 2*b*, 2*c* and 2*d* are in the region of 1.0. The second curve from the top in FIG. 1 shows the signal from the sensor if the fuel supply to cylinder 2*c* is being regulated to achieve a $\lambda$ value of about 0.88, while the $\lambda$ values for cylinders 2*a*, 2*b* and 2*d* are 1.03, and 1.0 respectively. In both these cases, the first and the second curve from the top, the overall excess air factor, i.e. as seen in the combined exhaust gas flow from all the cylinders, is approximately 0.98.

FIG. 5*a* shows the excess air factors ($\lambda$) for cylinder 2*a* (curve 1), cylinder 2*b* (curve 2), cylinder 2*c* (curve 3) and cylinder 2*d* (curve 4) as detected by a conventional lambda sonde inserted into each individual cylinder exhaust outlet, i.e. 7*a*, 7*b*, 7*c* and 7*d* in FIG. 1, during the engine running period shown in the upper curve of FIG. 4.

FIG. 5*b* shows in an equivalent manner the excess air factor ($\lambda$) for these cylinders during the engine running period shown in the second curve from the top in FIG. 4.

It can be seen from FIG. 4 how an individual rich combustion event can easily be distinguished from surrounding lean combustion events. The output signal from the sensor moves rapidly from a high to a low output signal level, which gives a typical binary signal characteristic. The pulse width of the output signal from the sensor, or the length of time it is in the lower signal level stage, differs from the expected quarter of the time period during the measurement, which is a consequence of the sensor's binary character, but also of the exhaust gas flow, the engine speed profile and the diluting effect of the residual exhaust gases in the exhaust piping. It can be seen from the upper curve in FIG. 4 that the sensor is indicating a lean air mixture of less than 1.0 for only 18% of the time, instead of the nominal and expected 25% proportion of the time. For cylinder 3*a*, the second curve from the top, which has much richer combustion, see also FIG. 6, the pulse width shows that a lean air mixture of less than 1.0 is indicated for approximately 40% of the total time. This phenomenon is utilised in the current invention in order to be able to determine the relative richness in an individual cylinder, even if the sensor is installed in an arrangement where the flow of exhaust gas from several cylinders passes by in a specific order.

With this specific sensor, information can thus be obtained on whether combustion has taken place with too much or too little air, i.e. net oxidising or net reducing, for each individual combustion event, even if only one sensor is used in the exhaust pipe at position 7*g*. At the same time, the relative air deficit, here in the form of an excess of HC, can be detected on the basis of the binary output signal pulse width.

If one also wishes to detect the relative deviation from stoichiometric combustion from the air deficit side as well, i.e. for values exceeding 1.0, a sensor combination can be employed using an oxygen-detecting sensor with equivalent characteristics.

With increasing richness a proportional increase of HC in the exhaust gases occurs, and with increasing leanness there is a proportional increase in oxygen. With selective binary sensors that are sensitive to HC and oxygen respectively, the relative deviation from the initial point, in either the direction of net reduction or net oxidation in the exhaust mixture, can be detected with the aid of the pulse width information in the binary signals from the respective sensors. In this way information obtained from two binary sensors can supply information equivalent to that from a linear sensor, at a much lower cost.

In for example "Thin-film gas sensors based on semiconducting metal oxides. Sensors & Actuators B23 (1995) 119–125. H. Meixner, J. Gerblinger, U. Lampe & M. Fleischer", an oxygen-sensitive sensor with the response that is required is described. This sensor combination could preferably be integrated on the same SiC substrate as the sensor shown in FIG. 3, thereby obtaining an integrated sensor matrix.

The actual pulse width of the binary signal can be determined by very simple means. FIG. 1 shows how the signal from a sensor 10 of this actual type is received by a comparator K, and as soon as the signal exceeds a reference voltage U the comparator provides a digital output signal to the engine control unit ECM. The engine control unit then starts a counter that determines the actual state of the signal when the digital output signal from the comparator changes sign, i.e. the instant when the output signal from sensor 10 falls below the reference voltage level U. The presence of the digital output signal is equivalent to the pulse width from sensor 10, which is stored in the memory 11 of the engine control unit. The signal presence may either be related to a particular time or to a number of crankshaft degrees through which the internal combustion engine manages to rotate. Since the engine control unit keeps track at all times of the crankshaft angle and engine speed, the pulse width can be matched to the cylinder that generated the rich running signal. The mixture signal from sensor 10 always appears after a certain delay from the instant the exhaust gas valve from the respective cylinder has begun to open.

If $CD_{SIGN}$ defines the crankshaft position for the signal after the exhaust valve has begun to open at crankshaft position $CD_{EO}$, the crankshaft position for the signal is coarsely defined, since: $CD_{SIGN}=CD_{EO}+f(rpm)$, where f(rpm) is a function dependent on the engine rotation speed.

f(RPM) is itself dependent on the actual geometry of the exhaust gas collection arrangement 7*a*–7*g*, and may, for a non-symmetric exhaust gas collector, be different for each cylinder.

The sequence of sensor signals from the exhaust gas pulses from the different cylinders is identical to the ignition sequence. The engine control unit can then use the measured pulse width to determine the relative richness and adaptively correlate the regulation so that this is equivalent to the relative size of the richness deviation. After each indicated richness signal the sensor pulse width information is kept in memory as a value $PW_{SIGN_CYL1}$ for example for cylinder number 1, whereupon the engine control unit will initiate a reduction in the amount of fuel fed to cylinder 1 at the next fuel injection inlet event. The reduction of the amount of fuel injected can take place in predetermined steps $\Delta T_{INJECT}$, where the next successive activation period for the injector $T_{INJECT_NEXT}$ is provided by the function:

$$T_{INJECT_NEXT_CYL.1}=T_{INJECT_PREV_CYL.1}\cdot(\Delta T_{INJECT} * PW_{SIGN_CYL1}),$$

where $T_{INJECT_PREV_CYL.1}$ is equivalent to the activation period for the injector derived from the preceding richness indication from the combustion event in cylinder number 1.

If the subsequent exhaust gas pulse from cylinder number 1 continues to indicate an over-rich mixture, a new value is obtained, $PW_{SIGN+1}$. If $PW_{SIGN+1}$ for example happens to be 50% of $PW_{SIGN}$, the predetermined corrective step $\Delta T_{INJECT}$ can include a further correction $\Delta T_{INJECT_Corr}$.

In this way the engine control unit can adaptively establish a matrix of correction steps $\Delta T_{INJECT}$, where the actual correction step $\Delta T_{INJECT}$ is successively increased or reduced, by the factor $\Delta T_{INJECT_Corr}$, if the regulatory measures do not return combustion to a stoichiometric level within a certain successive number of combustion events. The correction matrix is built up from at least the actual engine rotation speed and cylinder, whereby each individual cylinder can be corrected in an optimal way for every engine speed range.

With the type of sensor being discussed, it is important that it is arranged to be as close as possible to the point where the exhaust gases from several cylinders are combined. Optimally, the sensor should be located only a few centimeters after the exhaust gas stubs join. The further the sensor is located from the joining point, the more difficult it is for the sensor to distinguish individual over-rich combustion events from neighbouring lean combustion events. For this reason, even the transport distances for the exhaust gases should be minimised, and the whole exhaust gas collection system 7*a*–7*f* kept as compact as possible.

The present invention can be utilised for at least the greater part of the internal combustion engine operating range. Detection cylinder by cylinder can be blocked during, for example, idling, where the regulation is mainly applied to obtain and maintain a stable engine running speed. During idling, i.e. at engine rotation speeds of less than 1,000 rpm, the exhaust gas flow pattern can be very irregular.

The present invention is not limited to the above-mentioned applications. For example, a sensor can be arranged to be installed in the exhaust gas collection systems for each bank of cylinders in a Vee engine. In other solutions a sensor may also be installed in the exhaust manifold at a point where the exhaust gases from only two cylinders are combined. The important thing is that the relative richness of an individual cylinder can be detected in the combined gas flow from several cylinders. One may also use a combination of the sensor under discussion with a conventional lambda sonde. The conventional lambda sonde can supervise the combined gas flow and retain the detected value for maintaining an exhaust gas blend that is optimal for a catalytic converter. If, for example, the lambda sonde indicates that the total exhaust gas flow has a correct blend, an individually over-rich fuel-air mixture in one cylinder mean a reduction in the amount of fuel delivered during the next inlet event to that cylinder, while the other cylinders will receive a leaner fuel-air mixture. The leaner combustion in the other cylinders can however be limited or reversed if these after enrichment indicate over-richness from the binary sensor at their next combustion events. The sensor under discussion can best of all be complemented by a conventional lambda sonde with transients, i.e. on applying load, where more fuel is to be ramped, depending on the desired increase in engine power output. A problem connected with this is that it is more difficult to rapidly increase the air mass, so that fuel may be over-dosed at the initial stage of increasing load. Any over-richness during load application is detected immediately after every combustion event, and if a limited amount of extra rich injection shall be permitted, so one may during regulation permit additional fuel to be supplied sequentially to the different cylinders.

What is claimed is:

1. A regulating system for regulating an air-fuel mixture in an internal combustion engine including a plurality of cylinders, connected to an exhaust gas system including at least one point where exhaust gases from at least two of the cylinders are joined, the regulating system comprising:

a first binary sensor arranged for sensing the exhaust gases and producing a first output signal having a switching point from a first output signal level to a second output signal level, where the first output signal level is stable for so long as the air-fuel mixture is the exhaust gases is lean, and where the second output signal level is achieved when the air-fuel mixture in the exhaust gases is rich, the first binary sensor being located at the at least one point; and an engine control unit comprising first means for regulating the amount of fuel delivered to each of the plurality of cylinders in the engine depending upon at least one actual engine parameter, and applying a correction to the amount of delivered fuel depending on the first output signal from the first binary sensor;

second means for matching from which of the plurality of cylinders the sensed exhaust gases derive, third means for detecting a pulse width of the second output signal level of the first output signal and storing the pulse width as a first value in a memory as a combustion-related value;

fourth means arranged for ascertaining a level of richness of the air-fuel mixture in the exhaust gases in relation to the first value as well as actual operating conditions of the engine, including engine rotation speed provided by an engine rotation speed sensor; and fifth means for reducing the amount of delivered fuel to only that of the plurality of cylinders which after matching is indicated as having a rich mixture in the exhaust gases.

2. The regulating system of claim 1, further comprising a second binary senor arranged for sensing the exhaust part and producing a second output signal having a switching point from a first output signal level to a second output signal level, where the first output signal level is stable for so long as the air-fuel mixture in the exhaust gases is not lean, and where the second output signal level is achieved when the air-fuel mixture in the exhausted gases is lean, the second binary sensor being located at the at least one point.

3. The regulating system of claim 2, wherein the engine control unit further comprises sixth means for detecting a pulse width of the second output signal level of the second output signal and storing the pulse width of the second output signal level of the second output signal as a second value in the memory as another combustion-related value;

seventh means arranged for ascertaining a level of leanness of the air-fuel mixture in the exhaust gases in relation to the second value as well as actual operating condition of the engine, including engine rotation speed provided by the engine rotation speed sensor; and eighth means for increasing the amount of delivered fuel to only that of the plurality of cylinders which after matching is indicated as having a lean mixture in the exhaust gases.

4. The regulating system of claim 2, wherein the first binary sensor and the second binary sensor are arranged on one semi-conducting substrate.

5. The regulating system of claim 4 wherein the semi-conducting substrate comprises Silicon Carbide.

6. A process for determining an air-fuel mixture in a plurality of cylinders in an internal combustion engine including a binary sensor arranged in an exhaust gas system immediately downstream of at least one point where exhaust gases from at least two of the plurality of cylinders are joined, the process comprising the steps of:

providing an output signal from the binary sensor, the output signal having a switching point from a first output signal level to a second output signal level, where the first output signal level is stable for so long as the air-fuel mixture in the exhaust gases is not rich, and where the second output signal level is achieved when the air-fuel mixture in the exhaust gases is rich;

detecting angular engine position, thereby determining which of the at least two cylinders emitted the exhaust gasses sensed by the binary sensor, wherein each of the at least two cylinders can be matched to the output signal in a sequential order equivalent to an ignition sequence in the at least two cylinders, detecting a pulse width of at least one of the output signal levels, which pulse width can be measured in terms of time or crankshaft angle; and determining a relative deviation from stoichiometric combustion in the matching cylinder based upon the detected pulse width.

7. The process of claim 6, wherein the second output signal level indicating the air-fuel mixture in the exhaust gases as being rich, is used for further determining which of the at least two cylinders received excess fuel.

* * * * *

UNITED STATES PATENT AND TRADEMARK OFFICE

CERTIFICATE OF CORRECTION

PATENT NO. : 6,526,954 B1
DATED : March 4, 2003
INVENTOR(S) : Amir Baranzahi et al.

It is certified that error appears in the above-identified patent and that said Letters Patent is hereby corrected as shown below:

Column 7,
Line 44, after “mixture” delete “is” insert -- in --.

Signed and Sealed this

Sixteenth Day of September, 2003

JAMES E. ROGAN
*Director of the United States Patent and Trademark Office*